US009576713B2

(12) United States Patent
Goodman

(10) Patent No.: US 9,576,713 B2
(45) Date of Patent: Feb. 21, 2017

(54) VARIABLE RELUCTANCE TRANSDUCERS

(71) Applicant: Halliburton Energy Services, Inc., Houston, TX (US)

(72) Inventor: George David Goodman, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 124 days.

(21) Appl. No.: 14/365,196

(22) PCT Filed: Aug. 26, 2013

(86) PCT No.: PCT/US2013/056664
§ 371 (c)(1),
(2) Date: Jun. 13, 2014

(87) PCT Pub. No.: WO2015/030709
PCT Pub. Date: Mar. 5, 2015

(65) Prior Publication Data

US 2015/0084726 A1 Mar. 26, 2015

(51) Int. Cl.
*H01F 7/121* (2006.01)
*H01F 7/16* (2006.01)
*H01F 7/10* (2006.01)

(52) U.S. Cl.
CPC ..... *H01F 7/121* (2013.01); *H01F 7/1638* (2013.01); *H01F 7/10* (2013.01); *Y10T 156/10* (2015.01)

(58) Field of Classification Search
CPC ..... H02P 25/027; H01F 7/121
See application file for complete search history.

(56) References Cited

U.S. PATENT DOCUMENTS 2,434,337 A * 1/1948 Soderstrom ..... 318/129
2,696,592 A 12/1954 Petroff
2,903,673 A 9/1959 Harris
(Continued)

FOREIGN PATENT DOCUMENTS

DE 19805455 A1 * 9/1998
GB 1599506 10/1981
(Continued)

OTHER PUBLICATIONS

International Search Report and Written Opinion of the International Searching Authority issued in International Application No. PCT/US2013/056664 on May 27, 2014; 9 pages.
(Continued)

*Primary Examiner* — Mohamad Musleh
(74) *Attorney, Agent, or Firm* — Benjamin Fite; Parker Justiss, P.C.

(57) ABSTRACT

An example variable reluctance device includes a load structure connected to an armature through a connecting arm. The armature is positioned between two oppositely oriented core structures. A structural frame secures the core structures in a fixed position, forming gap regions between the core structures and the armature, forming a magnetic circuit. The armature is resiliently centered between the core structures by a spring, such that the gaps and are approximately equal in width when the armature is at rest. The device further includes a magnetic substance within the gaps that is compressed or stretched to allow movement of the armature.

29 Claims, 3 Drawing Sheets

(56) References Cited

U.S. PATENT DOCUMENTS

| | | | | | |
|---|---|---|---|---|---|
| 3,004,178 | A | | 10/1961 | Efromson et al. | |
| 3,018,467 | A | | 1/1962 | Harris | |
| 3,048,815 | A | | 8/1962 | Thurston et al. | |
| 3,274,538 | A | | 9/1966 | Snavely | |
| 3,308,423 | A | | 3/1967 | Massa, Jr. | |
| 3,435,393 | A | | 3/1969 | Meisel | |
| 3,439,198 | A | | 4/1969 | Lee | |
| 3,464,057 | A | | 8/1969 | Hayner et al. | |
| 3,538,358 | A | * | 11/1970 | Bauerle | 310/29 |
| 3,872,333 | A | | 3/1975 | Imbert et al. | |
| 4,048,602 | A | | 9/1977 | Diamantides | |
| 4,110,731 | A | | 8/1978 | Elswood | |
| 4,303,806 | A | | 12/1981 | Thiele | |
| 4,308,603 | A | | 12/1981 | Overby, III | |
| 4,361,879 | A | | 11/1982 | Dubbelday et al. | |
| 4,742,998 | A | | 5/1988 | Schubert | |
| 5,266,854 | A | | 11/1993 | Murray | |
| 5,267,737 | A | | 12/1993 | Cossette et al. | |
| 5,280,260 | A | * | 1/1994 | Juds et al. | 335/266 |
| 5,281,939 | A | * | 1/1994 | Juds et al. | 335/256 |
| 5,445,249 | A | | 8/1995 | Aida et al. | |
| 5,621,293 | A | * | 4/1997 | Gennesseaux | 318/687 |
| 5,808,839 | A | | 9/1998 | Dunfield et al. | |
| 5,896,076 | A | * | 4/1999 | van Namen | 335/229 |
| 5,973,422 | A | | 10/1999 | Clamme | |
| 6,095,486 | A | | 8/2000 | Ivers et al. | |
| 6,208,743 | B1 | | 3/2001 | Marten et al. | |
| 6,388,417 | B1 | | 5/2002 | Keith | |
| 6,555,229 | B1 | * | 4/2003 | Chen et al. | 428/421 |
| 6,879,076 | B2 | | 4/2005 | Long | |
| 7,288,860 | B2 | | 10/2007 | Cheung et al. | |
| 7,576,454 | B2 | | 8/2009 | Cheung et al. | |
| 7,990,136 | B2 | | 8/2011 | Frachon et al. | |
| 8,279,031 | B2 | | 10/2012 | Fullerton et al. | |
| 8,280,096 | B2 | | 10/2012 | Milot | |
| 2011/0133488 | A1 | | 6/2011 | Roberts et al. | |
| 2011/0278963 | A1 | | 11/2011 | Kaiser et al. | |
| 2012/0211316 | A1 | | 8/2012 | Shiao et al. | |

FOREIGN PATENT DOCUMENTS

| | | | |
|---|---|---|---|
| JP | 2002-177882 | | 6/2002 |
| KR | 10-2013-0025636 | | 3/2013 |
| WO | WO 98/48195 | | 10/1998 |
| WO | WO 0139588 | A1 * | 6/2001 |
| WO | WO 02/39781 | | 5/2002 |
| WO | WO 2011047801 | A1 * | 4/2011 |

OTHER PUBLICATIONS

Greper et al., "Problems in the utilization of magnetic fluid in electrodynamic loudspeaker heads", Magnetohydrodynamics , vol. 25, No. 2, Oct. 1989, 8 pages.

* cited by examiner

VARIABLE RELUCTANCE TRANSDUCERS

CLAIM OF PRIORITY

This application is a U.S. National Stage of PCT/US 2013/056664 filed on Aug. 26, 2013.

TECHNICAL FIELD

This disclosure relates to variable reluctance devices, and more particularly to a variable reluctance device for applying an oscillatory mechanical force to a load.

BACKGROUND

Electromagnetic transducers are widely used to convert electromagnetic energy into translational motion. Common categories of transducers include moving coil designs and moving armature designs, so named for the primary moving elements of each. The latter designs are often referred to as variable reluctance devices, as the magnetic reluctance, or the ratio of magnetomotive force to magnetic flux, varies as the magnetic armature moves in relation to a fixed magnetic structure.

Variable reluctance devices are frequently used in various applications including agitators, acoustic devices, and sensors. In these applications, a device should operate efficiently, such that large translational forces are converted efficiently from an applied excitation current. A device should also operate linearly, such that a flat translational response is produced over a broad range of excitation frequencies.

DESCRIPTION OF DRAWINGS

Like reference symbols in the various drawings indicate like elements.

DETAILED DESCRIPTION

Embodiments of the present subject matter may be used to improve any of a variety of devices with dynamic magnetic gap regions. These devices may include, for example, transducers, solenoids, relays, microphones speakers, displacement sensors, magnetic sensors, and mechanical vibrators. For illustrative purposes, the following description discusses embodiments of variable reluctance devices.

Figure 1:
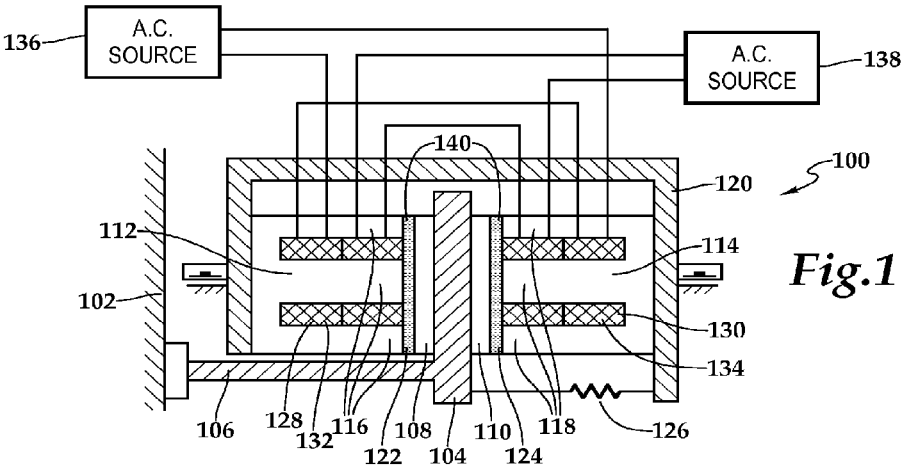
FIG. 1 is a schematic diagram of an example device.

FIG. 1 is a schematic diagram of an example embodiment of a variable reluctance device 100. Device 100 includes several magnetic structures that contain magnetic flux, and the magnetic structures are arranged to form one or more magnetic circuits. For instance, device 100 includes a load structure 102 connected to an armature 104 through a connecting arm 106. Armature 104 includes two sets of I-shaped laminations 108 and 110, oppositely disposed on armature 104. Armature 104 is positioned between two oppositely oriented core structures 112 and 114. Core structures 112 and 114 are formed from E-shaped laminations, and are positioned such that their leg portions 116 and 118 face inwardly towards armature 104. A structural frame 120 secures core structures 112 and 114 in a fixed position, such that gap region 122 is formed between the opposing outer surfaces (i.e. pole faces) of core structure 112 and lamination 108. In a similar manner, gap region 124 is formed between the opposing outer surfaces (i.e. pole faces) of core structure 114 and lamination 110. In this configuration, magnetic flux between core structure 112 and lamination 108 flows through the pole face of core structure 112, through gap region 122, and through the pole face of lamination 108, and vice versa, completing a magnetic circuit. In a similar manner, magnetic flux between core structure 114 and lamination 110 flows through the pole face of core structure 114, through gap region 124, and through the pole face of lamination 110, and vice versa, completing another magnetic circuit. Armature 104 is resiliently centered between core structures 112 and 114 by a spring 126, such that gaps 122 and 124 are approximately equal when armature 104 is at rest. In some implementations, spring 126 also provides mechanical damping of motion of the armature 104 relative to each of the core structures 112 and 114.

Core structures 112 and 114 are each wound by a first biasing winding 128 and 130, respectively, and by a second winding 132 and 134, respectively. Biasing windings 128 and 130 are connected to a supply of direct current (DC) 136, so that a biasing current from DC supply 136 biases the two magnetic circuits. The second windings 132 and 134 are connected to a supply of alternating current (AC) 138, so that an excitation current from AC supply 138 is applied to the two magnetic circuits. Windings 132 and 134 are installed or phased relative to the first windings 128 and 130, such that at any given moment when AC supply 138 is energized, one of the second windings 132 or 134 aids the corresponding first winding 128 or 130, while the other second winding 132 or 134 opposes the corresponding first winding 128 or 130. This phasing also causes any induced AC voltages in the DC windings to effectively cancel so that no substantial AC load is impressed on the DC supply. As the force exerted in a variable reluctance device is proportional to the absolute value of the square of the magnetomotive force or energizing current, energizing the device with an alternating current produces a highly non-linear force upon armature 104, which is exerted at twice the frequency of the exciting current. This force upon armature 104 correspondingly drives load 102 in an oscillating manner. Due to this oscillation, gaps 122 and 124 are dynamic, and have variable gap widths during the operation of device 100.

In general, the frequency and distance by which load 102 oscillates may vary depending on the desired oscillation characteristics of the device, the physical constraints of the particular application, and the frequency and voltage limitations of the AC power supply. In example embodiments, load 102 oscillates at a frequency between 20 Hz 20 kHz. In some embodiments, the oscillation of load 102 may be varied by the user, such as by varying the frequency of the induced AC voltage from supply 138. In some embodiments, the oscillation of load 102 may be varied during use, such that a range of oscillation frequencies may be induced during use.

In general, the widths of gaps 122 and 124 may vary. Typically, the gap widths are selected so that it is large enough to allow armature 104 to freely oscillate, while narrow enough to reduce magnetic tosses due to fringing effects. For instance, in some embodiments, the static gap width (i.e. the width of the gaps when armature 104 is in a steady state non-energized condition, for example when DC supply 136 and/or AC supply 138 is switched oft) is approximately 0.010 inches when armature 104 is statically centered. In some embodiments, the static gap width may vary between 0.1% to 10% of a pole face's cross-sectional length or width. For example, the gap width may be 0.5% of a pole face's cross-sectional length or width. The oscillatory displacement of armature 104 within gaps 122 and 124 may also vary. For instance, in some embodiments, the maximum displacement of armature 104 is approximately 50% of the static gap width, such that in a position of maximum displacement, one gap is approximately 50% of its static width, and the other gap is approximately 150% of its static width. In some embodiments, the maximum displacement of armature 104 may be greater than or less than 50%. For instance, the maximum displacement of armature 104 may vary between 0% to 80% of the static gap width.

While device 100 is illustrated as having two E-shaped core structures 112 and 114 and a single 1-shaped armature 104, this need not be the case. Core structures 112 and 114 and armature 104 may be of various shapes and configurations. For example, these structures may be rod-shaped, plane-shaped, E-shaped, I-shaped, U-shaped, C-shaped, or any other shape. Likewise, there need not be two core structures and one armature. For example, in some embodiments, there may be one core structure and one armature. Similarly, there need not be two gap regions. For example, in some embodiments, there may be one gap region formed between the pole face of a single core structure and a pole face of laminations of a single armature. In this manner, one or more gap regions may be formed between varying numbers of opposing pole faces.

Figure 2A:
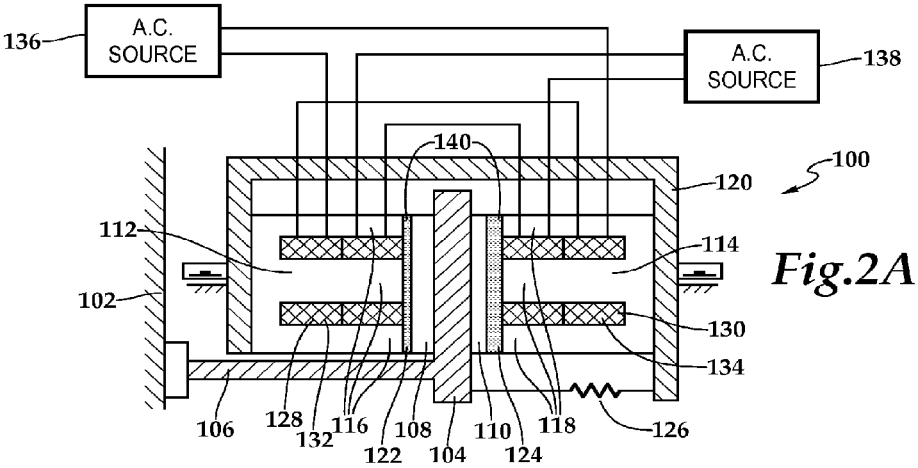
FIGS. 2A-B are schematic diagrams of an example devices.
Figure 2B:
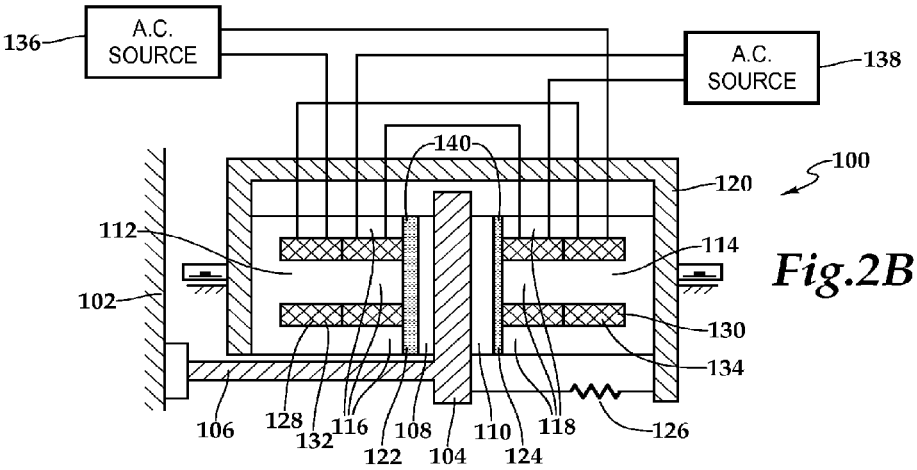

Device 100 further includes a magnetic substance 140 within gaps 122 and 124. As illustrated in FIG. 2, as armature 104 moves between core structures 112 and 114, magnetic substance 140 conforms to the width of gaps 122 and 124, and is compressed or stretched to allow movement of armature 104. Referring to FIG. 2A, a leftward motion of armature 104 causes gap 122 to narrow (compressing magnetic substance 140 within it), and causes gap 124 to expand (expanding magnetic substance 140 within it). A rightward motion is illustrated in FIG. 2B, showing an expansion and compression of magnetic substance 140 in gaps 122 and 124, respectively.

Magnetic substance may be retained within gaps 122 and 124 in various ways. In some embodiments, magnetic substance 140 is mechanically fixed within gaps 122 and 124, for instance through an adhesive, boot, or other retaining structure. In some embodiments, magnetic substance 140 is fixed within gaps 122 and 124 through magnetic forces between substance 140, armature 104, and core structures 112 and 114.

Magnetic substance 140 may be of any pliable or elastomeric magnetic substance, such as an elastomer with a polymer matrix impregnated with a ferromagnetic material. Suitable materials for each component may vary based on the desired mechanical and magnetic properties of the magnetic substance. The polymer matrix may be of various types, for example unsaturated rubbers (such as butyl rubber, nitrile rubber, or polyisoprene), or saturated rubbers (such as ethylene propylene rubber, silicone rubber, room temperature vulcanizing (WIN) silicone rubber, and fluoroelastomer). Materials may be selected based on various factors, such as their ability to accept loadings of magnetic power, and their mechanical properties, including the material's hardness, stress-strain, compression behavior, adhesion properties, viscoelasticity, stiffness, processability, vibration isolation characteristics, or other physical properties. In an illustrative example, an elastomer may be selected based on its dynamic stiffness and dampening. For instance, a butyl rubber may be selected, having a dynamic spring rate of approximately 70-200%, and a damping coefficient of approximately 15-100 pounds seconds per inch (lb·s/in) within an operating temperature range of approximately 0-90° C. If instead an elastomer is needed with lesser damping properties, a material such as a cis-polyisoprene elastomer may be selected, having a dynamic spring rate of approximately 70-200% and a damping coefficient of approximately 10-35 lbs/in within the same operating temperature range. In a similar manner, other materials may be chosen based on various other criteria, either instead of or in addition to these material properties. For instance, a material may be selected having a particular effective strain, such as a fluoroelastomer with an effective strain in the range of approximately 40% to 60%.

The ferromagnetic material may also be of various types, for example ceramic ferrites (such as barium or strontium ferrites) and rare-earth alloys such as samarium-cobalt or neodymium-iron boron). Ferromagnetic materials may vary in particle size. For example, particles may be powder-like (approximately 2 μm or less in diameter), or may be larger (such as approximately, 2-10μ in diameter, 10-300 μm in diameter, or over 300 μm in diameter). Ferromagnetic materials may be selected based on factors such as their size, initial permeability, saturation flux density, relative loss factor, resistivity, density, cost, or other factors. In an illustrative example, a ferromagnetic material may be selected based on its initial permeability. For instance, a manganese-zinc (MnZn) ferrite powder may be selected, having an initial relative permeability of approximately 1000-15,000. If instead a material is needed with a lower initial permeability, a material such as a nickel-zinc (NiZn) ferrite powder may be selected, having an initial relative permeability of approximately 100-1500. In a similar manner, other materials may be chosen based on various other criteria, either instead of or in addition to these material properties.

In example embodiments, magnetic substance 140 is a polymer-ferrite composite that includes a synthetic fluoropolymer elastomer fluoroelastomer (such as that commonly sold under the brand name DuPont Viton AL-600), impregnated with a high temperature nickel-zinc (NiZn) ferrite dust (such as that commonly sold under the brand name Unimagnet UR1K). Viton AL-600 is a terpolymer of hexafluoropropylene, vinylidene fluoride and tetrafluoroethylene, and is composed of approximately 98% 1-Propene, 1,1,2,3,3,3-hexafluoro-, polymer with 1,1-difluoroethene and tetrafluoroethene, and approximately 1% barium sulfate. Viton AL-600 exhibits a specific gravity of 1.77, and a nominal Mooney viscosity (ML 1+10 at 121° C.) of 60. Other elastomers may also be used, either in addition to or instead of Viton.

Ferrite dust UR1K is a soft ferrite material that is composed, in part, of NiZn magnetic material. Ferrite dust UR1K exhibits an initial permeability ($\mu_i$) of approximately 1000±20%, a saturation flux density $B_s$ of approximately 350 mT, a relatively loss factor ($\tan_\delta/\mu_i$) of less than approximately $40\times10^{-6}$, a relative temperature coefficient ($\alpha$) of less than $5\times10^{-6}$/K, a Curie temperature ($T_c$) of less than 120° C., a resistivity ($\rho$) of approximately 100,000 Ωm, and a density d of approximately $5\times10^3$ kg/m$^3$. In general, other ferromagnetic materials may be used where the initial permeability $\mu_i$ is approximately 50 or greater.

The composition of magnetic substance 140 may be varied in order to achieve the desired physical and magnetic properties. For instance, in some embodiments, magnetic substance 140 includes approximately 60% Viton and 40% ferrite dust UR1K, resulting in a net initial permeability of approximately 8. In other embodiments, magnetic substance 140 includes a greater percentage of ferrite, in order to increase the initial permeability of substance 140. For instance, magnetic substance 140 may include approximately 50% Viton and 50% ferrite dust, resulting in a magnetic substance 140 that is firmer and exhibits a higher magnetic permeability. In other embodiments, magnetic substance 140 includes greater amounts of the non-magnetic materials, in order to increase the elasticity, deformability, or other physical characteristics of substance 140. For instance, magnetic substance 140 may include approximately 80% Viton and 20% ferrite dust, resulting in a magnetic substance 140 that exhibits greater elasticity and lower magnetic permeability. In general, certain embodiments of magnetic substance 140 may contain between 20% to 97% elastomer (e.g. approximately 20%, 30%, 40%, 50%, 60%, 70%, 80%, or 90% elastomer) and between 3% to 80% of a magnetic material (e.g. approximately 10%, 20%, 30%, 40%, 50%, 60%, 70%, or 80% of a magnetic material). In this manner, the physical and magnetic properties of substance 140 may be adjusted to suit any specific application.

In some embodiments, magnetic substance 140 may contain additional materials to further alter the physical or magnetic properties of substance 140. In this manner, the physical and magnetic properties of substance 140 may be further adjusted to sun a particular application.

Filing gaps 122 and 124 with a magnetic substance increases the magnetic permeability of the gap region. Without wishing to be bound by the theory, the reluctance of a magnetic circuit is defined as the ratio of the magnetic path length to its cross sectional area divided by permeability. Inductance is the reciprocal of reluctance. As reluctances combine linearly over a magnetic circuit path, the performance of a variable reluctance device with air-filled magnetic gap regions may be compared to that of a variable reluctance device with magnetic gap regions Idled with a magnetic substance through the following relationship:

$$L_{air} = N^2 \frac{A_c \mu_0 \mu_{core}}{l_{core} + 4 l_g \mu_{core}},$$

$$L_m = N^2 \frac{A_c \mu_m \mu_0 \mu_{core}}{l_{core} \mu_m + 4 l_g \mu_{core}}, \text{ and}$$

$$\frac{L_m}{L_{air}} = \frac{\mu_m (l_{core} + 4 l_g \mu_{core})}{4 l_g \mu_{core} + l_{core} \mu_m},$$

where $L_{air}$ is the coil inductance with an air-filled magnetic gap region, $L_m$ is the coil inductance with a magnetic substance in the magnetic gap region, N is the total turns in windings of the coil, $A_c$ is the magnetic cross sectional area of the gap, $\mu_o$ is the permeability of free space, $\mu_m$ is the relative permeability of the magnetic substance, $\mu_{core}$ is the relative permeability of the core, $l_{core}$ is the length of the core, $l_g$ is the gap distance.

Thus, when high permeability transformer core materials are used in the core structure, the net gain in inductance is approximately equal to the product of the gap material's relative permeability and the device's initial inductance with only air filled gap regions. For example, in some embodiments of a device with a 0.01" static gap region formed between four pole faces, the inductance of the device increases 19.3 times when the air gap regions are filled by a magnetic substance with a relative permeability 20 times that of free space.

Figure 3:
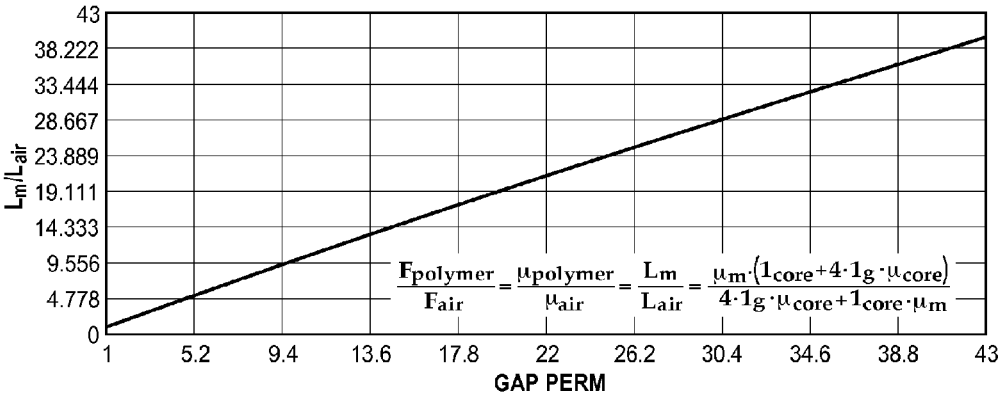
FIG. 3 shows the relationship between the gap permeability and the inductance of an example device.

Greater values of inductance yields increased flux generation within the magnetic structure per Ampere of excitation current. From Ampere's law:

$$\phi = LI,$$

the force generated by the variable reluctance device is proportion to the product of its magnetic circuit's permeability, flux intensity squared, and cross section area:

$$F = k\mu (H_e + H_m)^2 A_c,$$

where k is a geometry dependent constant, μ is the permeability, $H_e$ is the electromagnetic field intensity, $H_m$ is the static magnetic field intensity. Thus, it is apparent that the force generated by a device with the magnetic substance-filled gap region, relative to device with an air-filled gap region with otherwise identical electric current circulation, is equal to the ratio of the gap permeability of the two configurations. The relative force as a function of gap permeability is illustrated in FIG. 3.

The increase in the magnetic permeability of the gap regions 112 and 124 may provide several benefits. In some embodiments, magnetic substance 140 in gaps 122 and 124 increases the force that is applied upon armature 104 for a given excitation current applied to the windings 132 and 134. Thus, a greater amount of force is applied to armature 104 per ampere of excitation current.

In some embodiments, magnetic substance 140 in gaps 122 and 124 decreases the number of windings around core structures 112 and 114 that are needed to achieve a particular force. Device designs with fewer coil windings reduce the volume and mass requirements for the coils, and as a result, may also reduce the manufacturing cost of the devices while increasing reliability.

In some embodiments, magnetic substance 140 improves the mechanical dampening of the movement of armature 104 by physically opposing the motion of the armature 104. This dampening effect may result in a flatter, more linear force response as a function of excitation frequency. Thus, the amount of force applied to armature 104 per ampere of excitation current is relatively consistent over a range of frequencies of the excitation current.

In some embodiments, magnetic substance 140 provides gap equalization for gaps 122 and 124, or centralization of armature 104 within these gaps. For instance, magnetic substance 140 may be deformable, such that it may be compressed when armature 104 is forced towards a core structure 112 or 114. However, magnetic substance 140 may return to a pre-determined shape with pre-determined dimensions when the force is removed. Thus, magnetic substance 140 may be used to center armature 140 between core structures 112 and 114. In some embodiments, magnetic substance 140 is in a compressed positive pressure state, even when gap 122 or 124 is at its maximum width. Thus, magnetic substance 140 fills gaps 122 and 124, either partially or entirely, at all times, along the entire range of motion of armature 104. In these embodiments, the opposing forces of compressed magnetic substance 140 may also center armature 104 between core structures 112 and 114.

Figure 4A:
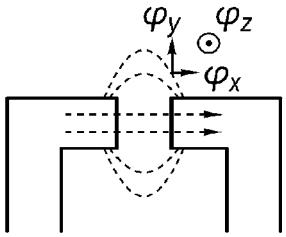
FIGS. 4A-B show examples of fringing flux.
Figure 4B:
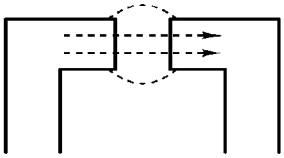

In some embodiments, magnetic substance 140 reduces electrical losses due to fringing flux in the dynamic gap region between magnetic poles. Typically, magnetic circuits are prone to flux leakage problems, as magnetic flux is very pervasive when it encounters a reluctance discontinuity along its magnetic path. The flux that leaks from its intended path in this manner is termed fringing flux, and is the most pervasive for large air-filled gaps. The fraction of total gap induced fringing flux can be estimated using the following equation:

$$\text{Fringing Flux} = \frac{l_g}{\sqrt{A_c}} \ln\left(\frac{2G}{l_g}\right),$$

where G is the mean magnetic path length, $l_g$ is the length of the gap, and $A_c$ is cross sectional area of the magnetic material. In an example variable reluctance device where $l_g$ is 0.025 cm, G is 16 cm, and $A_c$ is 4 $cm^2$, the nominal fringing flux is approximately 7.4%, with up to 10.4% flux lost to fringing at maximum mechanical displacement. Flux that escapes the intended magnetic path is free to impinge on other magnetic structures and conductive surfaces, inducing undesirable eddy currents. Fringing flux thus induces undesirable force vector components on the device's moving elements. The preferred flux direction is normal to the pole faces that form the gap. As illustrated in FIG. 4A, the preferred flux direction is along the x-axis. However, as the fringing flux expands outward from its intended magnetic path, it takes orthogonal components falling in both the y-axis and z-axis directions. As a result, undesirable response modes are generated by the device. When permeable material is introduced within the gap, the magnetic flux becomes much more contained. For example, in an embodiment where the relative permeability of the magnetic substance is more than 10 times that of free space, much less flux falls outside of its intended path, as illustrated in FIG. 4B. Thus, in some embodiments, magnetic substance 140 reduces orthogonal force components resulting from fringing flux in the magnetic pole region, thereby reducing its negative effects upon the oscillatory motion of the armature 104 as it oscillates between core structures 112 and 114.

In some embodiments, magnetic substance 140 provides mechanical dampening of force components that oppose the device's oscillatory movement performance. For example, magnetic substance 140 may reduce orthogonal forces or shear forces, such as those that arise when magnetic substance 140 is under compression. In addition, as devices with high-Q factor mechanical resonances may be problematic when generating a controlled response over a range of frequencies, dampening may be desirable in certain other circumstances, for instance to ensure that the oscillatory motion of armature 104 is rapidly ceased when excitation current is removed from windings 132 and 134. Hence, dampening may also reduce unwanted resonant behavior of device 100. Thus, in some embodiments, magnetic substance 140 may be selected based on physical parameters that to provide specific mechanical dampening properties to device 100. For instance, the elasticity or the hardness of the substance 140 may be selected to supplement the resistive forces of the mechanical spring 126 of device 100.

In some embodiments, magnetic substance 140 reduces the device's dependence on spring 126 when an elastic gap material is selected, such that armature 104 is resiliently centered by both magnetic substance 140 and the spring 126. In some embodiments, spring 126 is removed entirely, and armature 104 is resiliently centered between core structures 112 and 114 entirely by magnetic substance 140.

As magnetic substance 140 is not infinitely compressible, in some embodiments, magnetic substance 140 provides a physical separation between armature 104 and core structures 112 and 114, thereby eliminating discontinuities in the magnetic circuit that would occur if armature 104 contacts either core structure 112 or 114. Thus, gap regions 122 and 124 are preserved during operation of device 100, ensuring the continued operation of device 100. Similarly, the physical separation provided by magnetic substance 140 ensures that armature 104 will not contact either core structure 112 and 114, thereby preventing damage that arises from physical contact between components.

Figure 5:
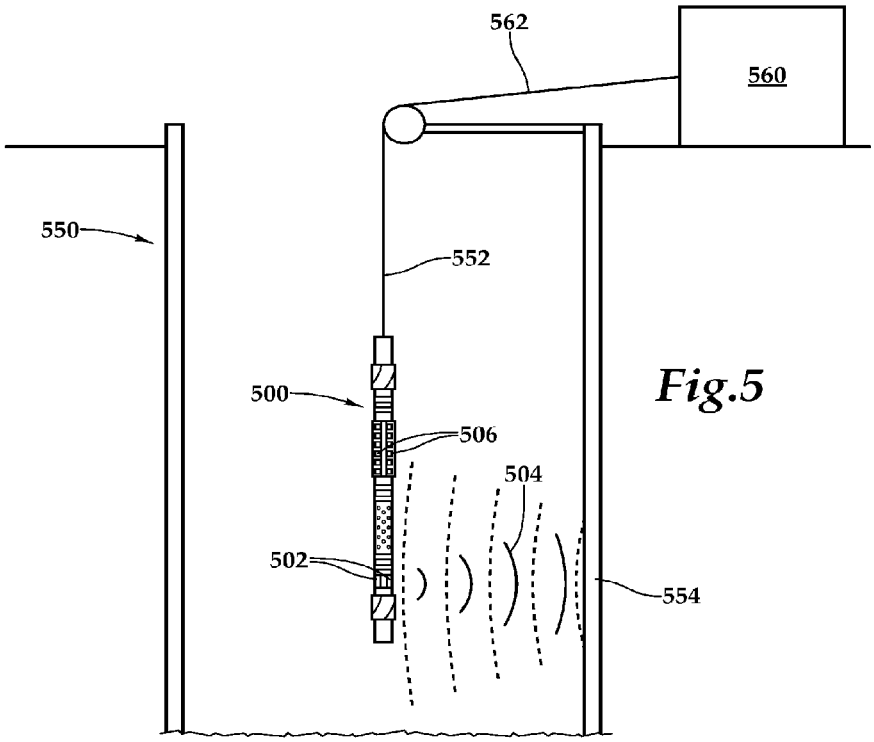
FIG. 5 shows an example sonic measurement device in a wireline configuration.

A number of embodiments of the technology have been described. Nevertheless, it will be understood that other implementations are possible. For example, the above embodiments illustrate general variable reluctance devices, where the dynamic gap regions of the device are filled with a magnetic, material in order to improve the device's operating characteristics. These variable reluctance devices may be used in conjunction with various systems for a variety of applications. For instance, embodiments can be used in acoustic and sonic measurement tools, such as those commonly used in oilfield drilling and/or formation evaluation applications. Referring to FIG. 5, an example sonic measurement tool 500 can be used in a wireline configuration. Tool 500 includes multiple variable reluctance transducers 502 arranged in a multiple element array. Sonic measurement tool 500 is suspended over a well using a support structure 562, and may be lowered into a welt 550, for example by extending a support cable 552 or other drill string structure. Once tool 500 is in position within the well 550, transducers 502 may be used as high amplitude transmitters to generate and direct acoustic energy 504 in specific shear and compressional modes into a surrounding medium 554. Receivers 506, arranged in a multiple element array on tool 500, detect energy that is reflected by the medium 554. Based on energy reflected by the medium, measurement tool 500 assesses and records the physical properties of a surrounding medium. Measurements from tool 500 may be transmitted through support cable 552 to a surface control system 560, where the measurements are reviewed by an operator. In some embodiments, either additionally or alternatively, measurements may be stored within tool 500 (e.g. in a data storage device) for future retrieval and review at the surface. Embodiments of this technology may be used to improve measurement tool 500 in various ways. For instance, one or more devices 100 could be disposed within each transducer 502, such that transducers 502 may be built smaller than transducers having air-fi lied dynamic gap regions. Thus, a tool 500 that includes transducers 502 may be built smaller with similar performance characteristics. In addition, embodiments of this technology may be used to improve the linearity of the acoustic response of transducers 502, and increase the acoustic energy produced by transducers 502, thereby increasing the performance and power efficiency of transducers 502.

Figure 6:
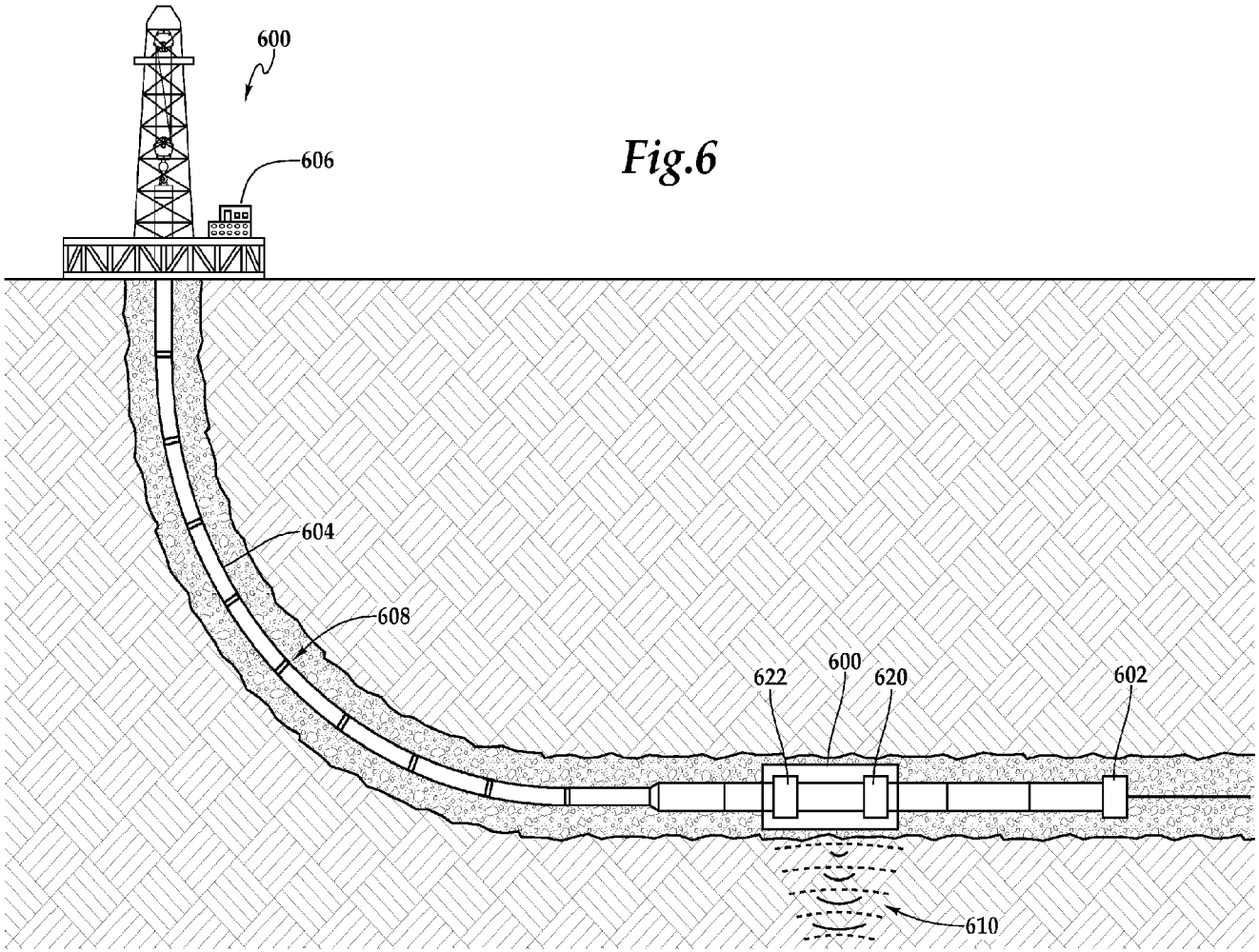
FIG. 6 shows an example sonic measurement device in a MWD/LWD configuration.

Referring to FIG. 6, in another example, a sonic measurement tool 600 can be used in a MWD/LWD configuration. In an example MWD/LWD operation, a drill unit 602 and the tool 600 are attached to a drill string 604. Using a surface control unit 606, an operator may direct a drill unit 602 along a three dimensional path, creating a borehole 608. During this process, the operator may use tool 600 to assess and record the physical properties of a surrounding medium 610. Tool 600 includes one or more transducers 620, which may be used as high amplitude transmitters to generate and direct acoustic energy 622 in specific shear and compressional modes into a surrounding medium 610. One or more receivers 624 are arranged on tool 600 to detect energy that is reflected by the medium 610. Based on energy reflected by the medium, measurement tool 600 assesses and records the physical properties of the surrounding medium 610. Measurements from tool 600 may be transmitted through drill string 604 to a surface control system 606, where they are reviewed by an operator. Additionally or alternatively, measurements may be stored within tool 600 (e.g. in a data storage device) for future retrieval and review at the surface. In this manner, an operator may use a surface control unit 602 to direct the operation of a drill unit 602, white using tool 600 to repeatedly assess medium 610. Embodiments of this technology may be used to improve measurement tool 600 in various ways. For instance, one or more devices 100 could be disposed within transducer 602. As a result, in a similar manner as described above, transducer 602 may be smaller, produce more acoustic energy, and/or may be more efficient than transducers having air-filled dynamic gap regions Similarly, embodiments of this technology can be used in a wide variety of drilling and/or formation evaluation applications, such as with transducers or variable reluctance devices used in wireline, slickline, coiled tubing, measurement while drilling (MWD), logging while drilling (LWD) operations.

Further, embodiments of the present subject matter may be applied to other types of devices with dynamic magnetic gap regions. For example, a compressible magnetic material may be added to the gap regions of devices such as relays, solenoids, microphones, speakers, displacement sensors, magnetic sensors, and mechanical vibrators, in order to increase the magnetic permeability of the gap region and to provide varying degrees of mechanical damping. For instance, in an example embodiment, the magnetic structures do not continuously oscillate relative to one another. Instead, each magnetic structure may have windings connected only to one or more DC sources. When a DC current is applied to windings of one or more of the magnetic structures, this causes the magnetic structures to change state relative to one another. That is, one magnetic structure may move closer to or further from the other, changing the width of the dynamic magnetic gap. As described above, the dynamic magnetic gap may be filled with a magnetic polymer in order to increase magnetic permeability of the gap region, reduce fringing flux, and increase mechanical damping. The example device may be several different states, such that the magnetic structures may move between several defined positions relative to one another, for instance in a double throw switch configuration.

Thus, a compressible magnetic material may be added to any device with a dynamic air gap formed between two or more opposing magnetic structures, where an increase in magnetic permeability, a reduction of fringing flux, and an increase in mechanical dampening are beneficial. Accordingly, other embodiments are within the scope of the following claims.

What is claimed is:

1. A device comprising:

a first magnetic structure;

a second magnetic structure configured to move relative to the first magnetic structure upon application of an electrical current across the second magnetic structure; and a gap of a variable width between the first magnetic structure and the second magnetic structure; and an elastomeric magnetic polymer disposed within the gap to conform to the variable width of the gap as the second magnetic structure moves relative to the first magnetic structure and to mechanically damp a motion of the second magnetic structure relative to the first magnetic structure.

2. The device of claim 1, wherein the second magnetic structure is configured to oscillate relative to the first magnetic structure upon application of an oscillation electrical current across the second magnetic structure.

3. The device of claim 1, wherein the magnetic polymer comprises a fluoroelastomer and a ferrite dust.

4. The device of claim 3, wherein the magnetic polymer comprises a composition of approximately 60% fluoroelastomer and approximately 40% ferrite dust.

5. The device of claim 3, wherein the magnetic polymer comprises approximately 20-97% fluoroelastomer and approximately 3-80% ferrite dust.

6. The device of claim 3, wherein the ferrite dust has an initial permeability of at least 50.

7. The device of claim 1, wherein the device is a variable reluctance device.

8. The device of claim 1, wherein when the device in an operational state, the device applies an oscillating force onto a load structure.

9. The device of claim 1, wherein the magnetic polymer is retained within the gap by a boot.

10. The device of claim 1, wherein the magnetic polymer is retained within the gap by an adhesive.

11. The device of claim 1, wherein the magnetic polymer is retained within the gap by a magnetic force between the magnetic polymer and the first magnetic structure.

12. The device of claim 1, wherein the magnetic polymer is retained within the gap by a magnetic force between the magnetic polymer and the second magnetic structure.

13. The device of claim 1, further comprising a spring that provides mechanical damping of the motion of the second magnetic structure relative to the first magnetic structure.

14. The device of claim 1, wherein the magnetic polymer is under positive pressure within the gap.

15. The device of claim 1, wherein the magnetic polymer fills the entirety of the magnetic gap between the first magnetic structure and the second magnetic structure.

16. The device of claim 1, wherein the device is a disposed in a transducer.

17. The device of claim 1, wherein the device is disposed within a solenoid.

18. The device of claim 1, wherein the device is disposed within a relay.

19. The device of claim 1, wherein the second magnetic structure is configured to move between two or more predetermined positions.

20. The device of claim 1, wherein the device is disposed in a sonic measurement tool.

21. A method of manufacturing a variable reluctance device comprising:

forming a dynamic magnetic gap by positioning a moveable magnetic structure in proximity with a static magnetic structure; and applying an elastomeric magnetic polymer within the magnetic gap such that the magnetic polymer conforms to the gap and substantially eliminates air between the moveable magnetic structure and the static magnetic structure.

22. The method of claim 21, further comprising affixing the magnetic polymer to the moveable magnetic structure and the static magnetic structure using an adhesive.

23. The method of claim 21, further comprising applying sufficient magnetic polymer within the magnetic gap such that the magnetic polymer is under positive pressure.

24. The method of claim 21, wherein the magnetic polymer comprises a fluoroelastomer and a ferrite dust.

25. The method of claim 21, wherein the magnetic polymer comprises a composition of approximately 60% fluoroelastomer and approximately 40% ferrite dust.

26. The method of claim 21, wherein the magnetic polymer comprises approximately 20-97% fluoroelastomer and approximately 3-80% ferrite dust.

27. The method of claim 21, wherein the ferrite dust has an initial permeability of at least 50.

28. A method, comprising:

providing a first magnetic structure and a second magnetic structure separated by a gap having a variable width, there being an elastomeric magnetic polymer within the gap; and applying an electrical current across the second magnetic structure to cause a relative motion between the first and second magnetic structures and the gap width to vary, wherein the magnetic polymer conforms to the varying gap width and mechanically damps the relative motion between the first and second magnetic structures.

29. The method of claim 28, wherein the relative motion is an oscillating motion and the electrical current is an oscillating electrical current.

* * * * *